US005133672A

United States Patent [19]

Nelligan, Jr. et al.

[11] Patent Number: 5,133,672

[45] Date of Patent: Jul. 28, 1992

[54] INSULATION DISPLACEMENT TERMINAL

[75] Inventors: Joseph W. Nelligan, Jr., LaGrange Park; Philip J. Dambach, Naperville; Jerry A. Long, Elgin, all of Ill.

[73] Assignee: Molex Incorporated, Lisle, Ill.

[21] Appl. No.: 742,793

[22] Filed: Aug. 9, 1991

[51] Int. Cl.[5] ..... H01R 4/24

[52] U.S. Cl. ..... 439/399; 439/397

[58] Field of Search ..... 439/391–407, 439/452, 460

[56] References Cited

U.S. PATENT DOCUMENTS

| | | | |
|---|---|---|---|
| 4,191,442 | 3/1980 | Caveney et al. | 339/99 R |
| 4,261,629 | 4/1981 | Reynolds et al. | 439/399 |
| 4,350,404 | 9/1982 | Clark et al. | 439/399 |
| 4,385,794 | 5/1983 | Lucius | 339/97 R |
| 4,940,425 | 6/1990 | Hass et al. | 439/397 |
| 4,941,842 | 7/1990 | Nakashima et al. | 439/399 |
| 4,983,130 | 1/1991 | Caveney et al. | 439/407 |
| 5,030,132 | 7/1991 | Hayes et al. | 439/400 |

*Primary Examiner*—David L. Pirlot
*Attorney, Agent, or Firm*—A. A. Tirva

[57] ABSTRACT

An electrical terminal is provided for insulation displacement termination of an electrical wire having a conductor core surrounded by an insulating sleeve. The terminal includes a forward mating end for engaging a complementary terminal and a rear terminating end for terminating the electrical wire. The rear terminating end includes at least a forward insulation displacement section, a forward strain relief section behind the forward insulation displacement section, a rear insulation displacement section behind the forward strain relief section, and a rear strain relief section behind the rear insulation displacement section. The rear terminating end of the terminal is generally U-shaped defining a bottom wall and space side walls. The strain relief sections are formed out of the spaced side walls, and the insulation displacement sections are formed out of the bottom wall.

16 Claims, 2 Drawing Sheets

INSULATION DISPLACEMENT TERMINAL

FIELD OF THE INVENTION

This invention generally relates to the art of electrical connectors and, particularly, to electrical terminals used in insulation piercing termination of insulated electrical wires.

BACKGROUND OF THE INVENTION

There are a wide variety of terminals used in electrical connectors for terminating the ends of electrical wires. Some terminals are of the crimping type for clamping onto an exposed conductor of an electrical wire. Other terminals are of the insulation displacement or piercing type which cut through the surrounding insulating sleeve of an electrical wire to establish conductivity with the center conductor core. Many such terminals of either type are unitarily fabricated of stamped and formed metal material.

A common form of a one-piece stamped and formed electrical terminal for making permanent electrical contact with the conductor core of an insulated electrical wire is configured generally with a U-shaped cross section. The cross section defines a bottom wall of the terminal and opposite side walls to provide a channel for the electrical wire. Opposed portions of the side walls are used for crimping inwardly onto the insulating sleeve of the wire to provide a strain relief means therefor. Insulation displacement sections of the terminal are formed either out of the side walls or the bottom wall of the terminal to define notches or slots having widths slightly smaller than the conductor core to establish a good electrical contact therewith, the sides of the notches or slits cutting through the insulating sleeve which surrounds the conductor core.

When using electrical terminals of the character described above, there are not many problems with small or fine electrical wires in regard to the wires backing out of the insulation displacement sections of the terminals, as long as some form of crimping means is provided for holding the wire in the channel of the terminal. Small wires simply bend in response to extraneous forces. However, when using "power cables" or large electrical wires, such as 18 gauge wires on the order of 0.078 inch diameter, problems in establishing a good connection with a stamped and formed terminal often arise. For instance, because of the heavy gauge of a power electrical wire, such as used in computer harnesses, the wires tend to pivot about the insulation displacement sections of the terminal rather than bending as with a smaller wire. For instance, if an insulation displacement section is disposed at the rearmost area of the termination portion of the terminal, the stiff wire tends to pivot about that section, particularly during handling, with a tendency of the wire to move out of the insulation displacement section.

Consequently, there has been a tendency to form terminals of the character described with at least a pair of insulation displacement sections for redundancy purposes to insure that a good contact is established with the conductor core of a heavy electrical wire. However, problems have been encountered in providing proper strain relief for the wires because they have a tendency to walk out of the forward-most insulation displacement section, in addition to pivoting about the rear most insulation displacement section.

This invention is directed to solving these problems by providing a stamped and formed electrical terminal with redundant insulation displacement sections and improved strain relief means operatively associated with each section.

SUMMARY OF THE INVENTION

An object, therefore, of the invention is to provide a new and improved electrical terminal adapted for insulation displacement termination of an electrical wire having a conductor core surrounded by an insulating sleeve.

In the exemplary embodiment of the invention, the terminal includes a forward mating end for engaging a complementary terminal, and a rear terminating end for terminating the electrical wire. The invention contemplates that the rear terminating end include at least a forward insulation displacement section, a forward strain relief section behind the forward insulation displacement section, a rear insulation displacement section behind the forward strain relief section and a rear strain relief section behind the rear insulation displacement section.

As disclosed herein, the electrical terminal is unitarily stamped and formed of metal material, with a generally U-shaped configuration in cross section, defining a bottom wall and spaced side walls. The strain relief sections are formed out of the spaced side walls and, as disclosed herein, are provided in the form of deformable crimping arms for crimping onto the insulating sleeve of the electrical wire. The insulation displacement sections are formed out of the bottom wall and, as disclosed herein, are provided in the form of slotted transverse walls for cutting through the insulating sleeve of the electrical wire. In the preferred embodiment, the rear strain relief section is located at the extreme rear end of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
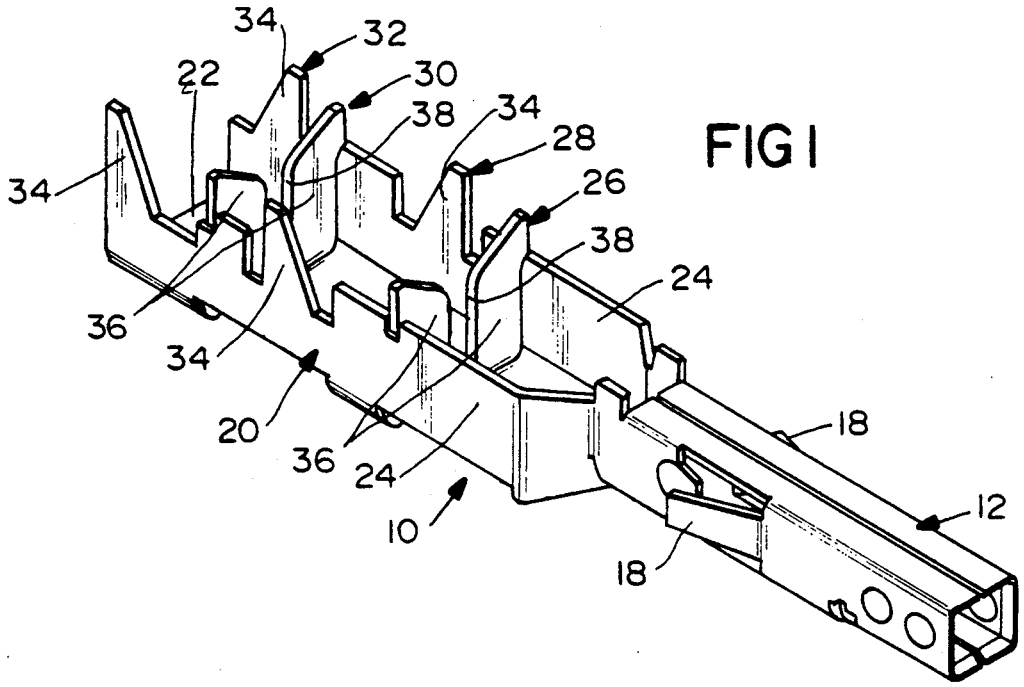
FIG. 1 is a perspective view of a female terminal embodying the concepts of the invention.
Figure 2:
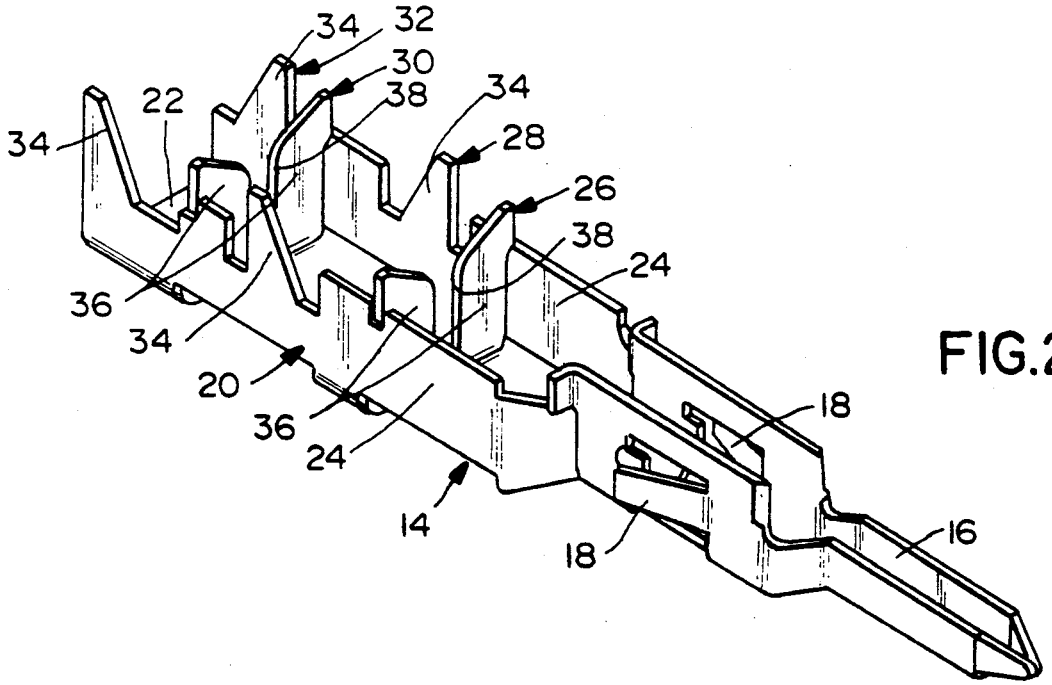
FIG. 2 is perspective view of a male terminal embodying the concepts of the invention.

Referring to the drawings in greater detail, and first to FIGS. 1 and 2, the invention is incorporated in electrical terminals of stamped and formed sheet metal material. FIG. 1 shows a female terminal, generally designated 10, and having a forward mating end, generally designated 12, of a box-like configuration in cross-section for receiving a complementary pin or male terminal. FIG. 2 shows a male terminal, generally designated 14, having a forward mating end, generally designated 16, in the form of a pin or male end for mating with a complementary terminal such as female mating end 12 of female terminal 10. Both forward mating end 12 of terminal 10 and forward mating end 16 of terminal 14 have stamped and outwardly formed resilient latch arms 18 for snapping behind appropriate locking shoulders inside of an appropriate connector housing.

Female terminal 10 and male terminal 14 each has a rear terminating end of identical configuration and, consequently, the rear terminating end of both terminals are designated with the common general reference numeral 20. More particularly, each rear terminating end 20 is generally U-shaped in cross section to define a bottom wall 22 and opposite side walls 24. The metal of the bottom wall and the side walls are utilized for forming the insulation displacement sections and strain relief sections of the terminals therefrom.

More particularly, the invention contemplates that each rear terminating end 20 of the terminals include at least a forward insulation displacement section, generally designated 26; a forward strain relief section, generally designated 28, behind forward insulation displacement section 26; a rear insulation displacement section, generally designated 30, behind forward strain relief section 28; and a rear strain relief section, generally designated 32, behind rear insulation displacement section 30.

Each strain relief section 28 and 32 includes a pair of crimping arms 34 projecting upwardly from side walls 24 for deforming inwardly to crimp onto the insulating sleeve surrounding a conductor core of an electrical wire.

Each insulation displacement section 26 and 30 includes a pair of arms or walls 36 stamped out of bottom wall 22 and bent upwardly to define a slot 38 between each pair of arms. The edges of slots 38 are spaced slightly less than the diameter of the conductor core of an insulated electrical wire for piercing through the insulating sleeve surrounding the core and establishing conductive contact with the core.

Figure 3:
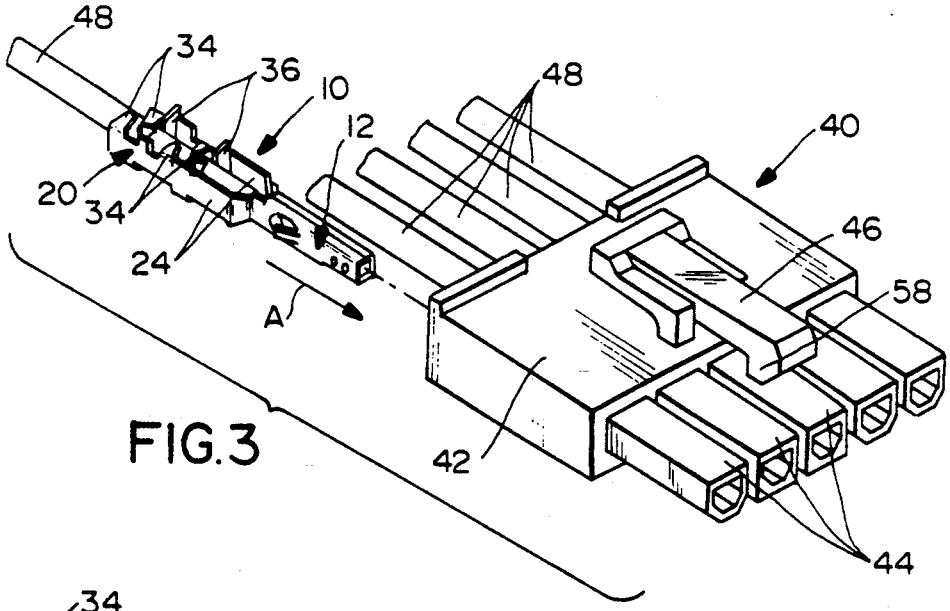
FIG. 3 is a perspective view of a receptacle connector assembly mounting a plurality of the female terminals of FIG. 1, with one terminal removed from the assembly to facilitate the illustration thereof.
Figure 4:
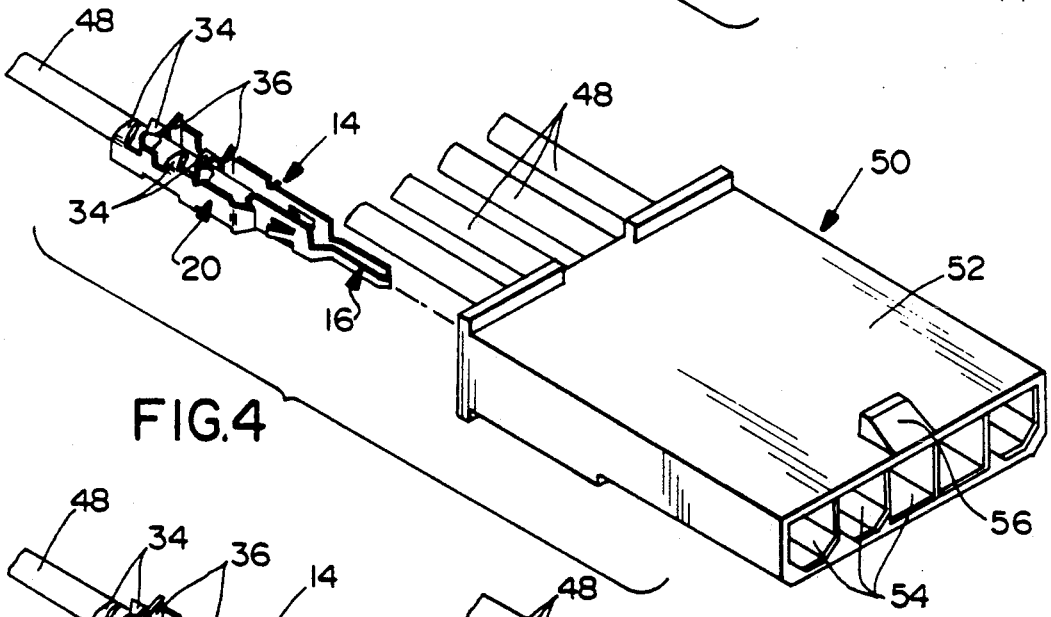
FIG. 4 is a view similar to that of FIG. 3, but illustrating a plug connector assembly mounting a plurality of the male terminals of FIG. 2.
Figure 5:
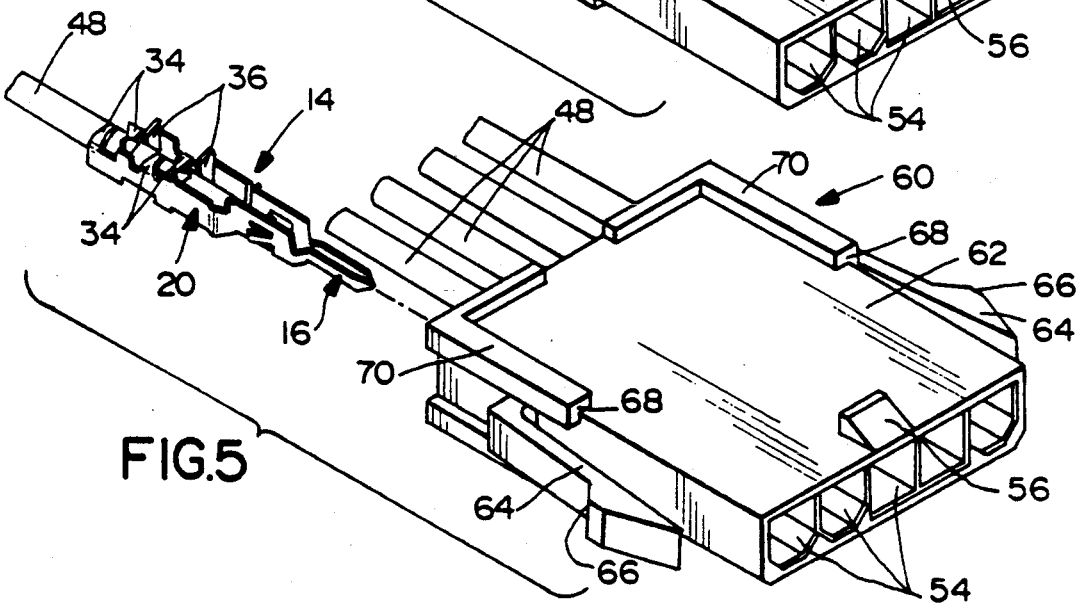
FIG. 5 is a view similar to that of FIGS. 3 and 4, but illustrating a panel mount plug connector assembly mounting a plurality of the male terminals of FIG. 2.

FIGS. 3-5 illustrate various examples of the use of terminals 10 and 14 in various connector assembly configurations. Specifically, FIG. 3 illustrates a receptacle connector assembly, generally designated 40, which includes a dielectric housing 42 having forwardly projecting silos 44. The silos define the front ends of through passages in the housing and into which female terminals 10 are inserted in the direction of arrow "A". A resilient latch arm 46 is integrally molded with dielectric housing 42 for latching engagement with a complementary plug connector assembly (FIG. 4). It can be seen that an insulated electrical wire 48 has been positioned in the channel between side walls 24 of the one illustrated female terminal 10. Insulation displacing arms 36 have pierced through the insulating sleeve of the wire, and crimping arms 34 have been deformed for crimping onto the outside of the insulating sleeve of the wire to provide strain relief therefor immediately behind both insulation displacement sections of the terminal.

FIG. 4 shows a plug connector assembly, generally designated 50, which includes a dielectric housing 52 having a plurality of through passages for receiving a complementary number of male terminals 14. Plug connector assembly 50 is adapted for mating with connector assembly 40 (FIG. 3). To that end, dielectric housing 52 has a plurality of openings 54 at the forward ends of the terminal-receiving through passages therein, for receiving silos 44 of receptacle connector assembly 40. A latching detent 56 is shown integral with the top of dielectric housing 52 for snapping engagement behind a hooked portion 58 of latch arm 46 (FIG. 3).

As with female terminal 10, shown in FIG. 3, male terminal 14, shown in FIG. 4, illustrates insulation displacement arms 36, piercing through the insulting sleeve of another insulated electrical wire 48, with crimping arms 34 being deformed inwardly for clamping onto the exterior of the insulating sleeve to provide strain relief therefor.

Lastly, FIG. 5 shows another type of connector assembly, namely a panel mount plug connector assembly, generally designated 60, which mounts a plurality of male terminals 14 as described in relation to plug connector assembly 50 in FIG. 4. Panel mount plug connector assembly 60 includes a dielectric housing 62 having integrally molded, resilient latch arms 64 on the sides thereof. The latch arms define shoulders 66 for snapping behind a panel which abuts against shoulders 68 at the ends of flanges 70 on top of the housing. Of course, countless configurations of electrical connector assemblies could be illustrated to exemplify the use of female and male terminals 10 and 14 respectively.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal adapted for insulation displacement termination of an electrical wire having a conductor core surrounded by an insulating sleeve, comprising:

a forward mating end for engaging a complementary terminal; and a rear terminating end for terminating the electrical wire, the rear terminating end including at least a forward insulation displacement section, a forward strain relief section behind the forward insulation displacement section, a rear insulation displacement section behind the forward strain relief section, and a rear strain relief section behind the rear insulation displacement section wherein at least one of said strain relief sections comprise means for crimping onto the insulating sleeve of the electrical wire.

2. The electrical terminal of claim 1 wherein said rear strain relief section is located at the extreme rear end of the terminal.

3. The electrical terminal of claim 1 wherein the terminal comprises a unitary stamped and forward component.

4. The electrical terminal of claim 3 wherein said rear terminating end is generally U-shaped defining bottom wall means and spaced side wall means.

5. The electrical terminal of claim 4 wherein said strain relief sections are formed out of said spaced side wall means.

6. The electrical terminal of claim 5 wherein said strain relief sections comprise deformable crimping arms.

7. The electrical terminal of claim 4 wherein said insulation displacement sections are formed out of said bottom wall means.

8. The electrical terminal of claim 7 wherein said insulation displacement sections comprise slotted transverse walls.

9. The electrical terminal of claim 8 wherein said strain relief sections are formed out of said spaced side wall means.

10. The electrical terminal of claim 9 wherein said strain relief sections comprise deformable crimping arms.

11. The electrical terminal of claim 1 wherein at least one of said insulation displacement sections comprises a slotted transverse wall for cutting through the insulating sleeve of the electrical wire.

12. The electrical terminal of claim 11 wherein at least one of said strain relief sections comprise means for crimping onto the insulating sleeve of the electrical wire.

13. A unitary electrical terminal of stamped and formed metal material and adapted for insulation displacement termination of an electrical wire having a conductor core surrounded by an insulating sleeve, comprising:

a forward mating end for engaging a complementary terminal; and a rear terminating end of a generally U-shaped configuration defining bottom wall means and spaced side wall means, the rear terminating end including at least a forward insulation displacement section, a forward strain relief section behind the forward insulation displacement section, a rear insulation displacement section behind the forward strain relief section, and a rear strain relief section behind the rear insulation displacement section, the strain relief sections being formed out of the spaced side wall means, the insulation displacement sections being formed out of the bottom wall means, and the rear strain relief section being located at the extreme rear end of the terminal.

14. The electrical terminal of claim 13 wherein said strain relief sections comprise deformable crimping arms.

15. The electrical terminal of claim 13 wherein said insulation displacement sections comprise slotted transverse walls.

16. The electrical terminal of claim 15 wherein said strain relief sections comprise deformable crimping arms.

* * * * *